US011851888B2

(12) United States Patent
Brochu

(10) Patent No.: US 11,851,888 B2
(45) Date of Patent: Dec. 26, 2023

(54) GUTTER ASSEMBLY AND COVER

(71) Applicant: Stephane Brochu, Lévis (CA)

(72) Inventor: Stephane Brochu, Lévis (CA)

( * ) Notice: Subject to any disclaimer, the term of this patent is extended or adjusted under 35 U.S.C. 154(b) by 0 days.

(21) Appl. No.: 18/097,395

(22) Filed: Jan. 16, 2023

(65) Prior Publication Data

US 2023/0175267 A1 Jun. 8, 2023

Related U.S. Application Data

(63) Continuation of application No. 17/513,313, filed on Oct. 28, 2021, now Pat. No. 11,585,094.

(60) Provisional application No. 63/107,169, filed on Oct. 29, 2020.

(51) Int. Cl.
*E04D 13/076* (2006.01)
*E04D 13/068* (2006.01)

(52) U.S. Cl.
CPC ..... *E04D 13/076* (2013.01); *E04D 13/068* (2013.01)

(58) Field of Classification Search
CPC .. E04D 13/076; E04D 13/068; E04D 13/0725
See application file for complete search history.

(56) References Cited

U.S. PATENT DOCUMENTS

| | | | |
|---|---|---|---|
| D90,272 | S | 7/1933 | White |
| 2,277,443 | A | 3/1942 | Livingston |
| 3,042,742 | A | 7/1962 | Foster |
| 3,295,803 | A | 1/1967 | Blayden |
| 3,436,878 | A | 4/1969 | Singer |
| 4,241,548 | A | 12/1980 | Rowe |
| 4,808,234 | A | 2/1989 | McKay et al. |
| 4,820,407 | A | 4/1989 | Lilie |
| 5,406,754 | A | 4/1995 | Cosby |
| 5,619,825 | A | 4/1997 | Leroney et al. |
| 5,744,218 | A | 4/1998 | Barnes |
| 5,906,287 | A | 5/1999 | Kohnen |
| 6,134,843 | A | 10/2000 | Tregear |
| D460,197 | S | 7/2002 | Stringer |
| 6,427,388 | B1 | 8/2002 | Brochu |

(Continued)

FOREIGN PATENT DOCUMENTS

| | | | |
|---|---|---|---|
| CA | 2305159 | A1 | 10/2001 |
| CA | 2451186 | A1 | 1/2003 |

(Continued)

*Primary Examiner* — Babajide A Demuren
(74) *Attorney, Agent, or Firm* — Reising Ethington P.C.

(57) ABSTRACT

A gutter assembly comprising: a gutter having a front gutter wall having a front inner lip; and a gutter cover comprising: a front cover mounting portion including: a rim abutting segment superposable to the front inner lip; and a lip retaining member resiliently and deflectably connected to the rim abutting segment, the lip retaining member extending downwardly and including a lip retaining segment extending forwardly from a rearward segment end of the rim abutting segment to define a lip receiving recess thereinbetween for receiving the front inner lip of the gutter, the lip retaining member further comprising a guiding member extending rearwardly and downwardly from the lip retaining segment, the lip retaining member being resiliently deflectable rearwardly by the guiding member abutting the front inner lip upon engagement of the gutter cover with the gutter.

19 Claims, 9 Drawing Sheets

(56) References Cited

U.S. PATENT DOCUMENTS

| | | | | |
|---|---|---|---|---|
| D468,446 | S | 1/2003 | Sender et al. | |
| 6,701,674 | B1 | 3/2004 | Albracht | |
| 6,786,008 | B2 | 9/2004 | Brochu | |
| 6,826,872 | B2 | 12/2004 | Brochu | |
| D523,538 | S | 6/2006 | Brochu | |
| D523,969 | S | 6/2006 | Aburzese et al. | |
| D551,740 | S | 9/2007 | Riley | |
| D558,309 | S | 12/2007 | Gregg | |
| D569,011 | S | 5/2008 | Brochu | |
| 7,624,541 | B2 | 12/2009 | Gentry | |
| 7,658,036 | B2 | 2/2010 | Banks et al. | |
| 7,765,743 | B2 | 8/2010 | Guilford | |
| 7,908,797 | B2 | 3/2011 | Graves | |
| 7,913,458 | B2 | 3/2011 | Higginbotham | |
| 8,037,641 | B2 | 10/2011 | Gerig | |
| D651,292 | S | 12/2011 | Geers | |
| 8,191,315 | B1 | 6/2012 | Brochu | |
| 8,322,082 | B2 | 12/2012 | Neumann | |
| 8,347,557 | B2 | 1/2013 | Minor, Sr. et al. | |
| 8,375,644 | B2 | 2/2013 | Robins | |
| D677,405 | S | 3/2013 | Landis | |
| 8,434,269 | B1 | 5/2013 | Brochu | |
| 8,479,454 | B2 | 7/2013 | Lenney et al. | |
| 8,635,811 | B2 | 1/2014 | Horton | |
| D719,648 | S | 12/2014 | Moody et al. | |
| D721,826 | S | 1/2015 | Ryan | |
| D723,671 | S | 3/2015 | Brochu | |
| 9,010,029 | B2 | 4/2015 | Higginbotham | |
| 9,010,030 | B2 | 4/2015 | Davis | |
| D736,900 | S | 8/2015 | Frelier | |
| 9,127,463 | B1 | 9/2015 | Feldhaus | |
| 9,163,406 | B1 | 10/2015 | Ealer, Sr. | |
| D742,541 | S | 11/2015 | Ryan | |
| D770,603 | S | 11/2016 | Fryml | |
| D782,624 | S | 3/2017 | Haendel | |
| 9,650,788 | B1 | 5/2017 | Ealer, Sr. | |
| D792,985 | S | 7/2017 | Jones | |
| D796,067 | S | 8/2017 | Landis et al. | |
| 11,060,293 | B2 | 7/2021 | Graves | |
| 2003/0110712 | A1 | 6/2003 | Brochu | |
| 2004/0060244 | A1 | 4/2004 | Brochu | |
| 2004/0118052 | A1 | 6/2004 | Brochu | |
| 2004/0182014 | A1 | 9/2004 | Brochu | |
| 2004/0244302 | A1 | 12/2004 | Neumann | |
| 2005/0028452 | A1 | 2/2005 | Brochu | |
| 2005/0115160 | A1 | 6/2005 | Brochu | |
| 2005/0193642 | A1 | 9/2005 | Brochu et al. | |
| 2005/0193671 | A1 | 9/2005 | Brochu et al. | |
| 2005/0223657 | A1 | 10/2005 | Brochu et al. | |
| 2005/0279036 | A1 | 12/2005 | Brochu | |
| 2006/0037254 | A1 | 2/2006 | Brochu | |
| 2006/0037255 | A1 | 2/2006 | Brochu | |
| 2006/0123710 | A1 | 6/2006 | Lenney et al. | |
| 2006/0283097 | A1 | 12/2006 | Gregg | |
| 2007/0012845 | A1* | 1/2007 | Iannelli | E04D 13/076 248/312.1 |
| 2007/0167130 | A1 | 7/2007 | Brochu | |
| 2007/0169423 | A1* | 7/2007 | Brochu | E04D 13/076 52/12 |
| 2008/0010906 | A1 | 1/2008 | Brochu | |
| 2008/0163561 | A1 | 7/2008 | Lenney et al. | |
| 2008/0190039 | A1 | 8/2008 | Brochu | |
| 2008/0190070 | A1 | 8/2008 | Duncan et al. | |
| 2008/0289263 | A1 | 11/2008 | Brochu | |
| 2009/0013612 | A1 | 1/2009 | Brochu | |
| 2009/0056234 | A1* | 3/2009 | Brochu | E04D 13/076 52/12 |
| 2009/0108144 | A1 | 4/2009 | Brochu | |
| 2010/0071273 | A1* | 3/2010 | Joly, Jr. | E04D 13/076 52/12 |
| 2010/0287846 | A1 | 11/2010 | Lenney | |
| 2011/0056145 | A1 | 3/2011 | Lenney | |
| 2011/0067317 | A1 | 3/2011 | Hedrick | |
| 2011/0067318 | A1 | 3/2011 | Lenney et al. | |
| 2011/0138698 | A1 | 6/2011 | Neumann | |
| 2012/0151849 | A1 | 6/2012 | Brochu | |
| 2013/0091780 | A1 | 4/2013 | Robins | |
| 2014/0069028 | A1 | 3/2014 | Lenney | |
| 2014/0215929 | A1 | 8/2014 | Lenney | |
| 2015/0020462 | A1 | 1/2015 | Iannelli | |
| 2015/0040488 | A1 | 2/2015 | Lenney | |
| 2015/0143756 | A1 | 5/2015 | Higginbotham | |
| 2015/0225959 | A1 | 8/2015 | Lenney | |
| 2015/0330085 | A1 | 11/2015 | Iannelli | |
| 2016/0060870 | A1 | 3/2016 | Martin | |
| 2016/0369512 | A1 | 12/2016 | Lenney | |
| 2018/0030733 | A1 | 2/2018 | Brochu | |
| 2020/0157820 | A1 | 5/2020 | Lenney | |
| 2021/0285224 | A1 | 9/2021 | Graves | |

FOREIGN PATENT DOCUMENTS

| | | | | |
|---|---|---|---|---|
| CA | 2405756 | A1 | 3/2004 | |
| CA | 2458005 | A1 | 8/2005 | |
| CA | 2460429 | A1 | 9/2005 | |
| CA | 2541186 | A1 | 7/2007 | |
| CA | 2593808 | A1 | 1/2009 | |
| CA | 2608530 | A1 | 4/2009 | |
| CA | 2747704 | A1 | 7/2009 | |
| CA | 2723499 | A1 | 3/2011 | |
| CA | 2723499 | A1 * | 3/2011 | E04D 13/076 |
| CA | 2727844 | A1 | 7/2012 | |
| CA | 2747513 | A1 | 1/2013 | |
| CA | 2783834 | A1 | 8/2013 | |
| CA | 2775864 | A1 | 11/2013 | |
| CA | 2933239 | A1 | 7/2015 | |
| CA | 2863023 | A1 | 3/2016 | |
| CA | 166698 | S | 8/2016 | |
| CA | 169577 | S | 2/2017 | |
| CA | 2907280 | A1 | 2/2017 | |
| CA | 2955268 | A1 | 7/2017 | |
| CA | 2919709 | A1 | 8/2017 | |
| CA | 2963962 | A1 | 10/2017 | |
| CA | 2931540 | A1 | 11/2017 | |
| CA | 175672 | S | 4/2018 | |
| CA | 2985004 | A1 | 5/2018 | |
| CA | 3016527 | A1 | 3/2019 | |
| CA | 3023339 | A1 | 5/2019 | |
| CA | 3045555 | A1 | 12/2020 | |
| EP | 1449980 | A1 | 8/2004 | |
| EP | 1627974 | A2 | 2/2006 | |
| EP | 2159342 | A1 | 3/2010 | |
| EP | 2177685 | A1 | 4/2010 | |
| EP | 2251500 | A1 | 11/2010 | |
| GB | 2481033 | A | 12/2011 | |
| GB | 2493284 | A | 1/2013 | |
| WO | 2007100320 | A1 | 9/2007 | |
| WO | 2008134845 | A1 | 11/2008 | |
| WO | 2009150174 | A1 | 12/2009 | |
| WO | 2015048116 | A1 | 4/2015 | |

* cited by examiner

GUTTER ASSEMBLY AND COVER

CROSS-REFERENCE TO RELATED APPLICATION(S)

The present application is a continuation of U.S. patent application Ser. No. 17/513,313 filed on Oct. 28, 2021, the entire specification of which is incorporated herein by reference and which claims priority from U.S. Provisional Patent Application No. 63/107,169, filed on Oct. 29, 2020, the entire specification of which is incorporated herein by reference.

TECHNICAL FIELD

The technical field generally relates to gutter covers, and more precisely to gutter covers engageable in a snap-fit engagement with a gutter.

BACKGROUND

Rain gutters are useful to collect rainwater that runs off the roof of a house or of a building and to route collected rainwater away from the foundation to a proper drainage area in order to avoid damages to the foundation, the soffit, the windows and/or the doors, for instance. Rain gutters generally include a trough channeling the rainwater to a downpipe or downspout, the trough being affixed to a supporting structure of the house or building such as the fascia board.

Leaves and debris may accumulate within the trough of the gutter, which can prevent the rainwater from flowing through the trough. Gutter guards or gutter covers are used to protect the gutter by preventing leaves and debris from enter the trough of the gutter while still permitting rainwater to enter the trough.

SUMMARY

According to one aspect, there is provided a gutter assembly comprising: a gutter having a front gutter wall, a rear gutter wall and a bottom gutter wall defining a gutter channel having an open top, the front gutter wall including an upright segment and a front inner lip extending rearwardly from the upright segment, the front inner lip including a rim segment having a front rim edge, a rear rim edge and a top rim surface extending between the front and rear rim edges; a gutter cover for covering the open top of the gutter, the gutter cover comprising: a front cover mounting portion operatively engageable with the front gutter wall, a rear cover mounting portion and a central cover portion extending between the front and rear cover mounting portions, the front cover mounting portion including: a rim abutting segment superposable to the top rim surface, the rim abutting segment having a front segment end and a rear segment end; a lip retaining member resiliently and deflectably connected to the rim abutting segment, the lip retaining member extending downwardly and including a lip retaining segment extending forwardly from the rearward segment end of the rim abutting segment to define a lip receiving recess therein between, the lip receiving recess being sized and shaped to receive the front inner lip of the gutter, the lip retaining member having an upper retaining member end and a lower retaining member end, the lip retaining member further comprising a guiding member extending rearwardly and downwardly from the lower retaining member end of the lip retaining segment, the front inner lip of the gutter being located inside the lip receiving recess when the gutter and the gutter cover are engaged together, the lip retaining member being resiliently deflectable rearwardly by the guiding member abutting the front inner lip upon engagement of the gutter cover with the gutter.

In at least one embodiment, the guiding member includes a guiding segment which is substantially planar.

In at least one embodiment, the guiding member is angled at an angle of between about 1 degree and 60 degrees relative to a vertical axis extending perpendicular to the rim abutting segment.

In at least one embodiment, the guiding member is angled at an angle of between about 20 degree and 40 degrees relative to the vertical axis.

In at least one embodiment, the guiding member includes a front end connected to the lip receiving section and a rear end, the guiding section being sized and angled such that the rear end is one of substantially vertically aligned with the rear rim edge of the front inner lip and located rearward of the rear rim edge when the front inner lip is received in the lip receiving recess.

In at least one embodiment, the rim abutting segment is sized and shaped to entirely cover the top rim surface when superposed therewith.

In at least one embodiment, the lip retaining segment is substantially planar and extends downwardly and frontwardly from the rear segment end of the rim abutting segment such that the lip receiving recess has a wedge-shaped configuration.

In at least one embodiment, the lip retaining segment is angled away from the rim abutting segment at an angle of between about 1 degree and 45 degrees.

In at least one embodiment, the gutter assembly comprises a first sheet comprising the front cover mounting portion, the first sheet being folded to form the rim abutting segment, the lip retaining member and the guiding member.

In at least one embodiment, the rim abutting segment includes a lower segment portion superposable against the top rim surface of the gutter, an upper segment portion superposed on the lower segment portion, and a 180-degree fold portion located at the front segment end of the rim abutting segment and connecting together the lower and upper segment portions.

In at least one embodiment, the first sheet comprises an upper segment defined in the central cover portion, the gutter cover further comprising a second sheet connectable to the first sheet and comprising a lower segment defined in the central cover portion, the upper segment extending above and being spaced apart from the lower segment, the upper segment having a first set of throughholes and the lower segment having a second set of throughholes.

In at least one embodiment, the second sheet extends between a front sheet end and a rear sheet end, the front sheet end being connectable to the first sheet proximal the front cover mounting portion and the rear sheet end being connectable to the first sheet proximal the rear cover mounting portion.

In at least one embodiment, the lower sheet comprises an intermediate lower sheet connector located between the front and rear sheet ends and wherein the upper sheet comprises an intermediate upper sheet connector positioned along the upper segment such that the intermediate lower and upper sheet connectors are aligned with each other and engageable with each other when the first and second sheets are connected together.

In at least one embodiment, the intermediate lower sheet connector includes a first hook member and the intermediate upper sheet connector includes a second hook member engageable with the first hook member.

In at least one embodiment, one of the first and second hook members extends rearwardly and the other one of the first and second hook members extends frontwardly.

In at least one embodiment, the first hook member extends frontwardly and the second hook member extends rearwardly.

In at least one embodiment, the rear cover mounting portion includes at least one resilient fold extending longitudinally along the gutter cover to allow the rear cover portion to be resiliently deformed when abutting against the rear gutter wall.

In at least one embodiment, the at least one resilient fold includes a 180-degree fold located adjacent the central cover portion.

In at least one embodiment, the 180-degree fold extends towards the front cover mounting portion and is positioned above the central cover portion.

In at least one embodiment, the 180-degree fold includes a lower segment portion superimposed over the central cover portion, an upper segment portion superimposed over the lower segment portion and a bend portion resiliently connecting the lower and upper segment portions and located towards the front cover mounting portion.

In at least one embodiment, the at least one resilient fold includes a plurality of rear portion folds spaced from each other in a widthwise direction relative to the gutter.

In at least one embodiment, the rear portion folds extend downwardly from the rear cover mounting portion.

In at least one embodiment, the gutter assembly further comprises a sealing member secured to an underside of the rear cover mounting portion, the sealing member being configured to abut the rear gutter wall to form a seal between the rear cover mounting portion and the rear gutter wall.

According to another aspect, there is also provided a gutter cover for covering the open top of a gutter, the gutter having a front gutter wall, a rear gutter wall and a bottom gutter wall defining a gutter channel having an open top, the front gutter wall including an upright segment and a front inner lip extending rearwardly from the upright segment, the front inner lip including a rim segment having a front rim edge, a rear rim edge and a top rim surface extending between the front and rear rim edges, the gutter cover comprising: a front cover mounting portion operatively engageable with the front gutter wall, a rear cover mounting portion and a central cover portion extending between the front and rear cover mounting portions, the front cover mounting portion including: a rim abutting segment superposable to the top rim surface, the rim abutting segment having a front segment end and a rear segment end; a lip retaining member resiliently and deflectably connected to the rim abutting segment, the lip retaining member extending downwardly and including a lip retaining segment extending forwardly from the rearward segment end of the rim abutting segment to define a lip receiving recess therein between, the lip receiving recess being sized and shaped to receive the front inner lip of the gutter, the lip retaining member having an upper retaining member end and a lower retaining member end, the lip retaining member further comprising a guiding member extending rearwardly and downwardly from the lower retaining member end of the lip retaining segment, the front inner lip of the gutter being located inside the lip receiving recess when the gutter and the gutter cover are engaged together, the lip retaining member being resiliently deflectable rearwardly by the guiding member abutting the front inner lip upon engagement of the gutter cover with the gutter.

In at least one embodiment, the guiding member includes a guiding segment which is substantially planar.

In at least one embodiment, the guiding member is angled at an angle of between about 1 degree and 60 degrees relative to a vertical axis extending perpendicular to the rim abutting segment.

In at least one embodiment, the guiding member is angled at an angle of between about 20 degree and 40 degrees relative to the vertical axis.

In at least one embodiment, the guiding member includes a front end connected to the lip receiving section and a rear end, the guiding section being sized and angled such that the rear end is one of substantially vertically aligned with the rear rim edge of the front inner lip and located rearward of the rear rim edge when the front inner lip is received in the lip receiving recess.

In at least one embodiment, the rim abutting segment is sized and shaped to entirely cover the top rim surface when superposed therewith.

In at least one embodiment, the lip retaining segment is substantially planar and extends downwardly and frontwardly from the rear segment end of the rim abutting segment such that the lip receiving recess has a wedge-shaped configuration.

In at least one embodiment, the lip retaining segment is angled away from the rim abutting segment at an angle of between about 1 degree and 45 degrees.

In at least one embodiment, the gutter cover comprises a first sheet comprising the front cover mounting portion, the first sheet being folded to form the rim abutting segment, the lip retaining member and the guiding member.

In at least one embodiment, the rim abutting segment includes a lower segment portion superposable against the top rim surface of the gutter, an upper segment portion superposed on the lower segment portion, and a 180-degree fold portion located at the front segment end of the rim abutting segment and connecting together the lower and upper segment portions.

In at least one embodiment, the first sheet comprises an upper segment defined in the central cover portion, the gutter cover further comprising a second sheet connectable to the first sheet and comprising a lower segment defined in the central cover portion, the upper segment extending above and being spaced apart from the lower segment, the upper segment having a first set of throughholes and the lower segment having a second set of throughholes.

In at least one embodiment, the second sheet extends between a front sheet end and a rear sheet end, the front sheet end being connectable to the first sheet proximal the front cover mounting portion and the rear sheet end being connectable to the first sheet proximal the rear cover mounting portion.

In at least one embodiment, the lower sheet comprises an intermediate lower sheet connector located between the front and rear sheet ends and wherein the upper sheet comprises an intermediate upper sheet connector positioned along the upper segment such that the intermediate lower and upper sheet connectors are aligned with each other and engageable with each other when the first and second sheets are connected together.

In at least one embodiment, the intermediate lower sheet connector includes a first hook member and the intermediate upper sheet connector includes a second hook member engageable with the first hook member.

In at least one embodiment, one of the first and second hook members extends rearwardly and the other one of the first and second hook members extends frontwardly.

In at least one embodiment, the first hook member extends frontwardly and the second hook member extends rearwardly.

In at least one embodiment, the rear cover mounting portion includes at least one resilient fold extending longitudinally along the gutter cover to allow the rear cover portion to be resiliently deformed when abutting against the rear gutter wall.

In at least one embodiment, the at least one resilient fold includes a 180-degree fold located adjacent the central cover portion.

In at least one embodiment, the 180-degree fold extends towards the front cover mounting portion and is positioned above the central cover portion.

In at least one embodiment, the 180-degree fold includes a lower segment portion superimposed over the central cover portion, an upper segment portion superimposed over the lower segment portion and a bend portion resiliently connecting the lower and upper segment portions and located towards the front cover mounting portion.

In at least one embodiment, the at least one resilient fold includes a plurality of rear portion folds spaced from each other in a widthwise direction relative to the gutter.

In at least one embodiment, the rear portion folds extend downwardly from the rear cover mounting portion.

In at least one embodiment, the gutter cover further comprises a sealing member secured to an underside of the rear cover mounting portion, the sealing member being configured to abut the rear gutter wall to form a seal between the rear cover mounting portion and the rear gutter wall.

According to yet another aspect, there is also provided a gutter cover for covering an opening of a gutter having a front gutter wall, a rear gutter wall and a bottom gutter wall defining a gutter channel, the gutter cover comprising: a front cover mounting portion operatively engageable with the front wall of the gutter, a rear cover mounting portion operatively engageable with the rear wall of the gutter and a central cover portion extending between the front cover mounting portion and the rear cover mounting portion, the rear cover mounting portion including at least one resilient fold extending longitudinally along the gutter cover to allow the rear cover portion to be resiliently deformed when abutting against the rear gutter wall.

In at least one embodiment, the at least one resilient fold includes a 180-degree fold located adjacent the central cover portion.

In at least one embodiment, the 180-degree fold extends towards the front cover mounting portion and is positioned above the central cover portion.

In at least one embodiment, the 180-degree fold includes a lower segment portion superimposed over the central cover portion, an upper segment portion superimposed over the lower segment portion and a bend portion resiliently connecting the lower and upper segment portions and located towards the front cover mounting portion.

In at least one embodiment, the at least one resilient fold includes a plurality of rear portion folds spaced from each other in a widthwise direction relative to the gutter.

In at least one embodiment, the plurality of rear portion folds includes two rear portion folds.

In at least one embodiment, at least one of the rear portion folds extends downwardly from the rear cover mounting portion.

In at least one embodiment, all the rear portion folds extend downwardly from the rear cover mounting portion.

In at least one embodiment, the gutter cover further comprises a sealing member secured to an underside of the rear cover mounting portion, the sealing member being configured to abut the rear gutter wall to form a seal between the rear cover mounting portion and the rear gutter wall.

According to yet another aspect, there is also provided a gutter cover for covering an opening of a gutter having a front gutter wall, a rear gutter wall and a bottom gutter wall defining a gutter channel, the gutter cover comprising: a front cover mounting portion operatively engageable with the front wall of the gutter, a rear cover mounting portion operatively engageable with the rear wall of the gutter and a central cover portion extending between the front cover mounting portion and the rear cover mounting portion, the rear cover mounting portion including at least one scoring groove extending in a longitudinal direction relative to the gutter, the rear cover mounting portion being made of a first material which is substantially flexible and which is separable along the at least one scoring groove to thereby reduce a width of the rear cover mounting portion.

In at least one embodiment, the first material includes a polymer.

In at least one embodiment, the rear cover mounting portion has a thickness between about ⅛ inch and 1/16 inch.

In at least one embodiment, the front cover mounting portion and the central cover portion are made of a second material different from the first material.

DETAILED DESCRIPTION

Figure 1:
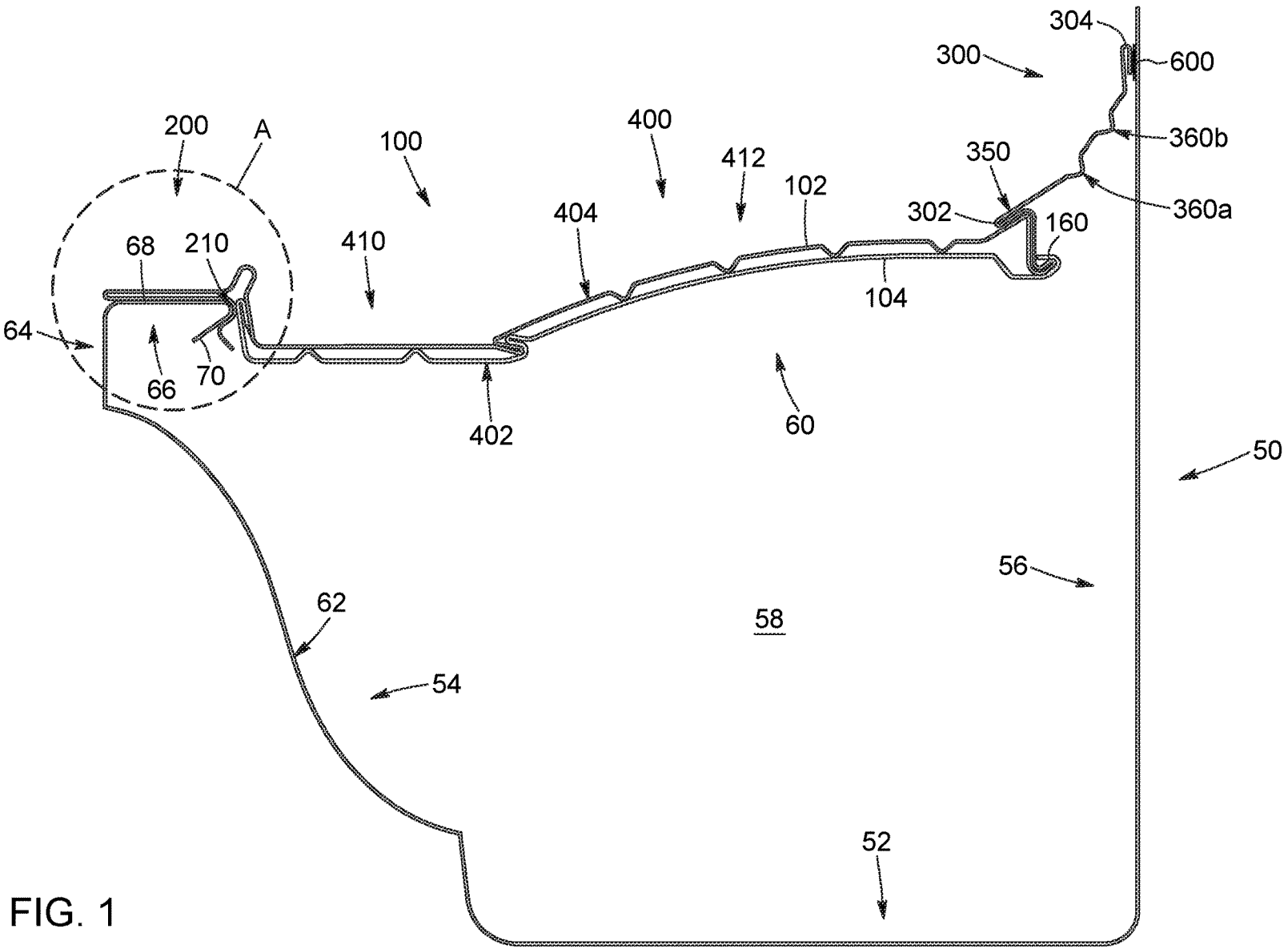
FIG. 1 is a cross-section view of a gutter cover installed on a gutter, in accordance with one embodiment.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art, that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

For the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Moreover, it will be appreciated that positional descriptions such as "above", "below", "top", "bottom", "forward", "rearward" "left", "right" and the like should, unless otherwise indicated, be taken in the context of the figures and correspond to the position and orientation in the gutter, gutter cover and corresponding parts when being used. Positional descriptions should not be considered limiting.

Referring to FIGS. 1 to 4, there is shown a gutter cover 100, in accordance with one embodiment. The gutter cover 100 is installable on a gutter 50, shown in FIG. 1, which can be secured to a supporting surface, such as a wall and/or a roof of a building.

As further shown in FIG. 1, the gutter 50 includes a bottom gutter wall 52 and front and rear gutter walls 54, 56 extending upwardly from the bottom gutter wall 52 to define a gutter channel 58 having an open top 60.

In the illustrated embodiment, the front gutter wall 54 includes an inclined lower segment 62 extending upwardly and frontwardly from the bottom gutter wall 52, an upright segment 64 extending upwardly from the inclined lower segment 62 and a front inner lip 66 which extends rearwardly from the upright segment 64.

Figure 3A:
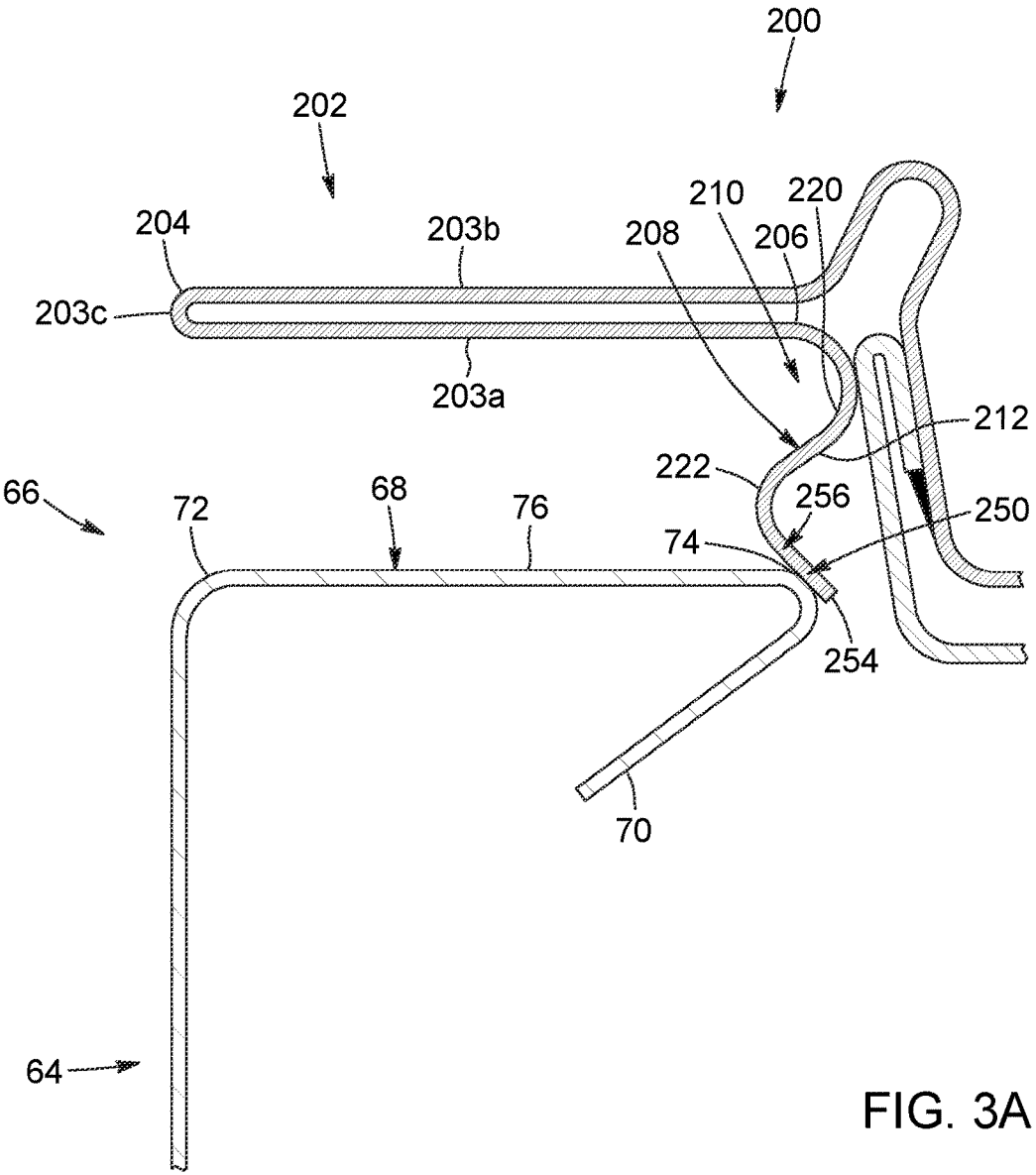
FIG. 3A is an enlarged portion of the cross-section view of the gutter cover and gutter illustrated in FIG. 1, taken from area A, showing a front cover mounting portion of the gutter cover positioned above a front inner lip of a gutter and abutting the front inner lip.
Figure 3B:
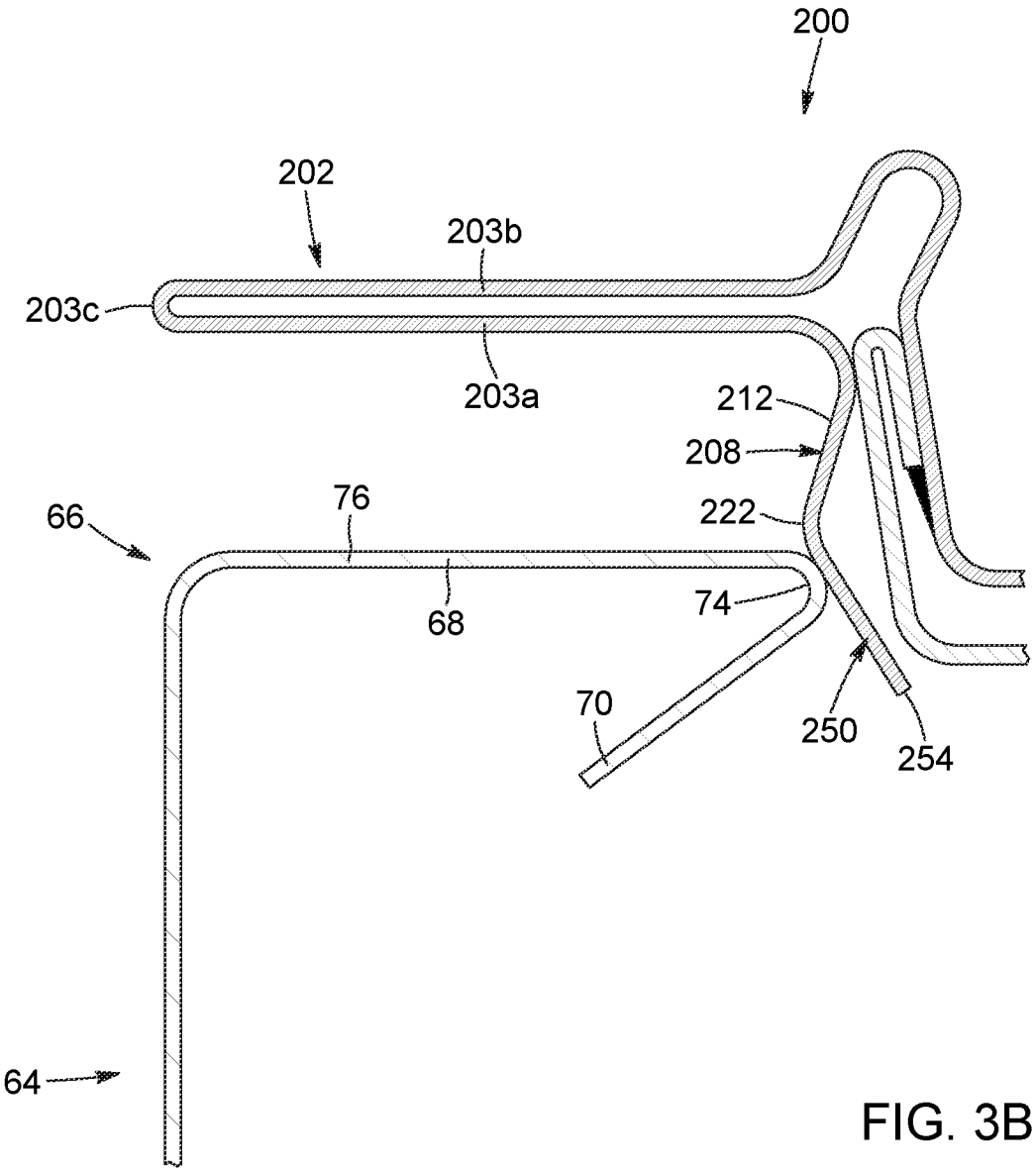
FIG. 3B is an enlarged portion of the cross-section view of the gutter cover and gutter illustrated in FIG. 1, taken from area A, showing the front cover mounting portion of the gutter cover being deformed and partially engaged with the front inner lip of a gutter.

Still in the illustrated embodiment, the front inner lip 66 is substantially wedge-shaped and includes a rim segment 68 and a front flange 70 angled away from the rim segment 68. Specifically, the rim segment 68 and the front flange 70 are angled relative to each other so as to define an acute angle thereinbetween. As best shown in FIGS. 3A and 3B, the rim segment 68 includes a front rim edge 72 adjacent the upright segment 64, a rear rim edge 74 located opposite the front rim edge 72 and a top rim surface 76 extending between the front and rear rim edges 72, 74. The front rim edge 72 and the rear rim edge 74 extend along folds between the upright segment 64 and the rim segment 68 and between the rim segment 68 and the front flange 70 respectively. The front flange 70 extends downwardly and frontwardly from the rear rim edge 74 towards the upright segment 64. In the illustrated embodiment, the top rim surface 76 and the front flange 70 are substantially planar. Alternatively, the top rim surface 76 and/or the front flange 70 could be substantially convexly or concavely curved or have any other shape and configuration. In another embodiment, instead of being wedge-shaped, the front inner lip 66 could instead be substantially rectangular or have any other suitable shape.

In the illustrated embodiment, the gutter cover 100 includes a front cover mounting portion 200 operatively engageable with the front wall 54 of the gutter 100, a rear cover mounting portion 300 operatively engageable with the rear wall 56 of the gutter 50 and a central cover portion 400 extending between the front and rear cover mounting portions 200, 300. As shown in FIG. 1, when installed on the gutter 50, the gutter cover 100 thereby covers the open top 60 of the gutter 50. The central cover portion 400 further has a plurality of throughholes 500, shown in FIG. 4, defined therein to allow liquid such as rainwater to enter the gutter channel 58 of the gutter 50 through its open top 60.

In the illustrated embodiment, the central cover portion 400 includes a lower segment 402 and an upper segment 404 extending above and mostly spaced apart from the lower segment 402. The upper segment 404 has a first set of throughholes 502, and the lower segment 402 has a second set of throughholes, not shown, which allow water to pass through the upper and lower segments 404, 402 to enter the gutter 50. The first and second set of throughholes could be offset relative to each other, aligned with each other or be disposed in accordance with any other suitable configuration.

In the illustrated embodiment, the gutter cover 100 comprises only two distinct pieces: an upper sheet 102 and a lower sheet 104. Specifically, the upper sheet 102 comprises the front cover mounting portion 200, the rear cover mounting portion 300 and the upper segment 404 of the central cover portion 400, while the lower sheet 104 comprises the lower segment 402 of the central cover portion 400. In other words, the front and rear cover mounting portion 200, 300 are formed by folding and bending respectively front and rear ends of the upper sheet 102 in the appropriate shape, while the lower sheet 104 extends substantially only along the central cover portion 400. Alternatively, the front and rear cover mounting portions 200, 300 could instead include multiple distinct components assembled together using any suitable assembly technique such as welding and the like. Still alternatively, the front and rear cover mounting portions 200, 300 could instead be formed by folding and bending respectively front and rear ends of the lower sheet 104 in the appropriate shape, or by folding and bending respectively the front and rear ends of both the upper sheet 102 and the lower sheet 104.

In the illustrated embodiment, the front cover mounting portion 200 includes a rim abutting segment 202 which extends between a front segment end 204 and a rear segment end 206 and a lip retaining member 208 which extends downwardly from the rear segment end 206. In this configuration, the lip retaining member 208 and the rim abutting segment 202 together form a lip receiving recess 210 therebetween.

In the illustrated embodiment, the rim abutting segment 202 is double-layered and includes a lower segment portion 203*a*, an upper segment portion 203*b* superposed over the lower segment portion 203*a* and a 180-degree fold portion 203*c* which is located at the front segment end 204 and which connects together the lower and upper segment portions 203*a*, 203*b*. Alternatively, the rim abutting segment 202 may not include two superposed segment portions and may instead include a single segment portion.

Figure 3C:
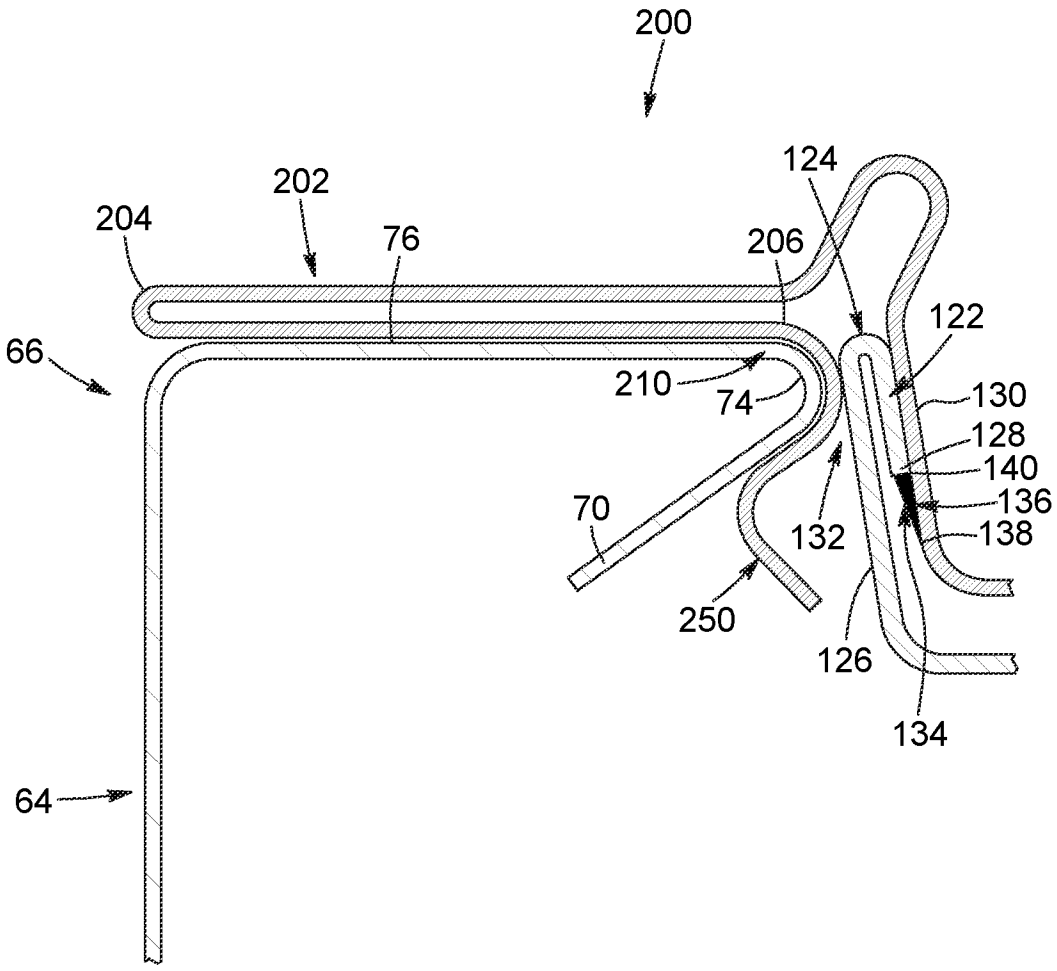
FIG. 3C is an enlarged portion of the cross-section view of the gutter cover and gutter illustrated in FIG. 1, taken from area A, showing a front cover mounting portion of the gutter cover being fully engaged with a front inner lip of a gutter.
Figure 4:
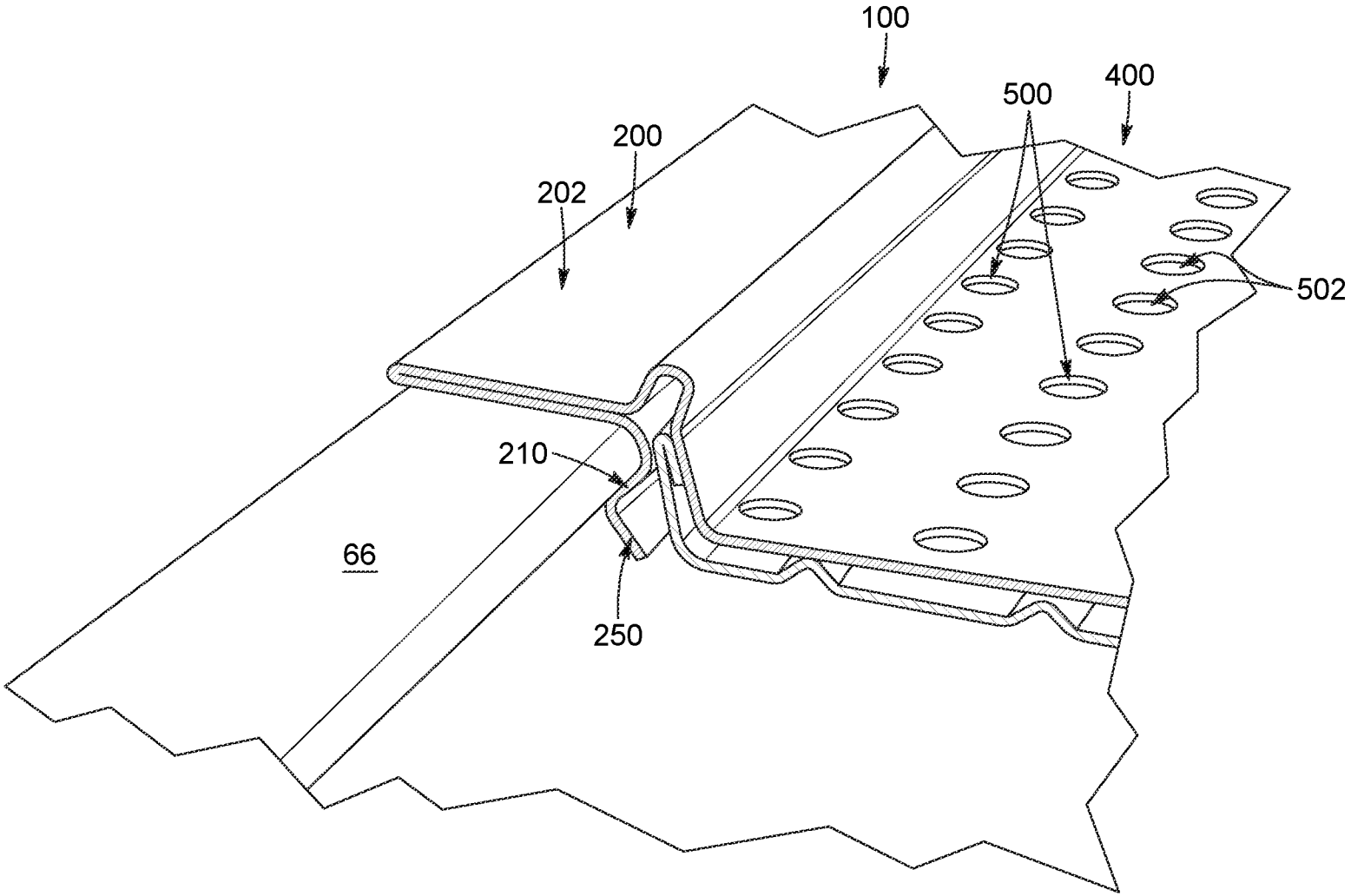
FIG. 4 is a perspective view showing an enlarged view of the front cover mounting portion of the gutter cover and gutter illustrated in FIG. 1 engaging the front inner lip of the gutter.

As shown in FIGS. 1 and 3C, the lip receiving recess 210 is sized and shaped to snuggly receive the front inner lip 66 of the gutter 50. In the illustrated embodiment, since the front inner lip 66 is wedge-shaped as described above, the lip receiving recess 210 is also wedge-shaped. Specifically, the lip retaining member 208 includes a lip retaining segment 212 which is substantially planar and which extends downwardly and forwardly from the rear segment end 206. The lip retaining segment 212 delimitates the lip receiving recess 210 and is angled away from the rim abutting segment 202 at an angle which substantially corresponds to an angle between the rim segment 68 and the front flange 70 of the front inner lip 66. In the embodiment shown, the angle defined between the rim abutting segment 202 and the lip retaining segment 212 of the lip retaining member 208 is an acute angle. According to this configuration, when the gutter cover 100 is installed on the gutter 50, the front inner lip 66 of the gutter 50 is received in the lip receiving recess 210 such that the rear rim edge 74 is located adjacent to the rear segment end 206 of the rim abutting segment 202 and such that the lip retaining segment 212 extends along the front flange 70 of the front inner lip 66.

In one embodiment, the front flange 70 of the front inner lip 66 is angled away from the rim segment 68 at an angle of between about 1 degree and 45 degrees, and the lip retaining segment 212 is angled away from the rim abutting segment 202 at a corresponding angle of between about 1 degree and 45 degrees. Alternatively, the front flange 70 of the front inner lip 66 may be angled away from the rim segment 68 at an angle of more than 45 degrees, with the lip retaining segment 212 being angled away from the rim abutting segment 202 at substantially the same angle.

In one embodiment, the lip retaining segment 212 could be angled away from the rim abutting segment 202 at an angle which is slightly smaller than the angle between the front flange 70 of the front inner lip 66 and the rim segment 68. In this embodiment, the lip retaining segment 212 and the rim abutting segment 202 would remain slightly biased towards each other in order to substantially pinch the front inner lip 66 of the gutter 50 when the front inner lip 66 is received in the lip receiving recess 210.

It will be understood that in other embodiments in which the front inner lip 66 of the gutter 50 is not wedge-shaped, the lip receiving recess 210 could have another shape corresponding to the shape of the front inner lip 66. For example, both the front inner lip 66 and the lip receiving recess 210 could be substantially rectangular, concavely curved, convexly curved or have any other suitable shape.

In other embodiments, the lip receiving recess 210 may not be sized and shaped to snuggly receive the front inner lip 66. For example, the lip retaining member 208 may not contact the front flange 70 of the front inner lip 66 along the entire length of the lip retaining member 208 when the front inner lip 66 is received in the lip receiving recess 210. Instead, the lip retaining member 208 could be configured such that only part of the lip retaining member 208 contacts the lip retaining member 208 when the front inner lip 66 is received in the lip receiving recess 210. In this embodiment, the lip retaining segment 212 may therefore not be planar and may instead be curved, zig-zag shaped or be configured according to any other suitable configuration.

Still referring to FIGS. 1 to 4, the lip retaining segment 212 extends between an upper retaining member end 220 located at the rear segment end 206 and a lower retaining member end 222 located opposite the upper retaining member end 220. In the illustrated embodiment, the upper and lower retaining member ends 220, 222 correspond to folds defined in the upper sheet 102 of the gutter cover 100 and provide a connection with adjacent gutter cover segments, i.e. the lower segment portion 203*a* of the abutting segment 202 and a guiding segment 250, which will be explained in further details below.

It will be understood that to install the gutter cover 100 on the gutter 50, it may be desirable to engage the front cover mounting portion 200 with the front inner lip 66 by positioning the front cover mounting portion 200 above the front inner lip 66, in substantially vertical alignment therewith, and by lowering the front cover mounting portion 200 towards the front inner lip 66. For example, the gutter cover 100 could be positioned such that the rear cover mounting portion 300 is proximal to or abuts the rear gutter wall 56 and such that the front gutter mounting portion 200 is positioned above and in substantially vertical alignment with the front inner lip 66, and then the entire gutter cover 100 could be lowered towards the gutter 50. Alternatively, the rear cover mounting portion 300 could be engaged with the rear gutter wall 56 while the front gutter mounting portion 200 is positioned above and in substantially vertical alignment with the front inner lip 66, and the gutter cover 100 could then be pivoted about the rear cover mounting portion 300 until the front cover mounting portion 200 engages the front inner lip 66.

As best shown in FIG. 3A, when the gutter cover 100 is positioned above the gutter 50 such that the front cover mounting portion 200 is in substantially vertical alignment with the rear rim edge 74 of the front inner lip 66, the lower retaining member end 222 of the lip retaining segment 212 is located frontwardly from the rear rim edge 74 of the front inner lip 66. To prevent the lip retaining segment 212 from abutting the top rim surface 76 of the front inner lip 66 when the front cover portion mounting portion 200 is lowered towards the front inner lip 66, which would prevent the front inner lip 66 from entering the lip receiving recess 210, the lip retaining member 208 of the front cover mounting portion 200 further includes the guiding segment 250 which is configured to move the lower retaining member end 222 of the lip retaining segment 212 rearwardly as the front cover portion mounting portion 200 is lowered towards the front inner lip 66.

In the illustrated embodiment, the guiding member 250 extends downwardly and rearwardly from the lower retaining member end 222 of the lip retaining segment 212 and is configured to abut the front inner lip 66 when the front cover portion 200 is lowered towards the front inner lip 66. Specifically, the guiding member 250 extends between the lower retaining member end 222 of the lip retaining segment 212 and a lower guiding member end 254, which corresponds to a free end of the lip retaining member 208. As shown in FIG. 3A, to engage the front cover mounting portion 200 with the gutter 50, the front cover mounting portion 200 is positioned over the gutter 50 such that the rear rim edge 74 is in substantially vertical alignment with the rear segment end 206 of the rim abutting segment 202 and/or in a position wherein the lower guiding member end 254 of the guiding member 250 extends rearwardly of the rear rim edge 74 of the front inner lip 66 and/or in a position wherein the guiding member 250 abuts against the rear rim edge 74 of the front inner lip 66. In other words, the lower guiding member end 254 is in substantially vertical alignment with the rear rim edge 74 or, alternatively, could be located rearwardly from the rear rim edge 74.

In the illustrated embodiment, the guiding member 250 includes a guiding segment 256 which is substantially planar. The guiding segment 256 may be angled at an angle of between about 1 degree and 60 degrees relative to a vertical axis extending perpendicular to the rim abutting segment 202, and more particularly at an angle of between about 20 degree and 40 degrees relative to the vertical axis. Alternatively, the guiding member 250 may not be fully planar and could instead be partially or fully curved or have another suitable configuration.

The lip retaining segment 212 is further resiliently and movably connected to the rim abutting segment 202 such that when the guiding member 250 contacts the top rim surface 76 and the front cover mounting portion 200 is moved further downwardly, the front inner lip 66, and more specifically the rear segment edge 74 of the rim segment 68, slides along the guiding member 250 such that the guiding member 250 moves rearwardly. This causes the lower retaining member end 222 of the lip retaining segment 212 to also move rearwardly, as shown in FIG. 3B. The front cover mounting portion 200 can then further be moved downwardly until the lower retaining member end 222 is positioned rearwardly of the rear segment edge 74 such that the lip retaining segment 212 clears the front inner lip 66 entirely. Further downward movement of the front cover portion 200 will cause the front inner lip 66 to enter the lip receiving recess 210. Since the lip retaining segment 212 is resiliently connected to the rim abutting segment 202, once the front cover mounting portion 200 has been lowered such that the lower retaining member end 222 of the lip retaining segment 212 is located below the rear segment edge 74, the lip retaining segment 212 moves back frontwardly by substantially sliding against the front flange 70 of the front inner lip 66 until the rim abutting segment 202 abuts the top rim surface 76. In the illustrated embodiment, when the rim abutting segment 202 abuts the top rim surface 76, the lip retaining segment 212 fully extends along the front flange 70, as shown in FIG. 3C.

Alternatively, to engage the front cover portion 200 of the gutter cover 100 with the gutter 50, the gutter cover 100 can be positioned with the front cover portion 200 adjacent to the front inner lip 66 of the gutter 50 and the central cover portion 400 and the rear cover mounting portion 300 being located above the front cover portion 200 of the gutter cover 100. Then, the front inner lip 66 of the gutter 50, and more particularly the rear segment edge 74, can be inserted in the lip receiving recess 210 and followed by a downward pivoting movement of the central cover portion 400 and the rear cover mounting portion 300 of the gutter cover 100 about upper retaining member end 220 abutting against the rear segment edge 74. The central cover portion 400 and the rear cover mounting portion 300 of the gutter cover 100 are pivoted downwardly until the rear cover mounting portion 300 of the gutter cover 100 is configured in a desired configuration with respect to the rear wall 56 of the gutter 50.

It will be appreciated that this configuration defines a snap-fit connection between the front cover mounting portion 200 and the front inner lip 66, which may substantially facilitate the installation of the gutter cover 100 on the gutter 50.

As explained above, in the illustrated embodiment, the rim abutting segment 202, the lip retaining segment 212 and the guiding member 250 are all made by folding and bending the upper sheet 102. During the insertion of the front inner lip 66 in the lip receiving recess 210 as described above, one or more of the rim abutting segment 202, the lip retaining segment 212 and the guiding member 250 could be flexed or deformed and resiliently regain its initial configuration once the front inner lip 66 is fully inserted in the lip receiving recess 210. Alternatively, the lip retaining segment 212 could be resiliently connected to the rim abutting segment 202 according to another configuration. For example, the lip retaining segment 212 could be connected to the rim abutting segment 202 by a live hinge coupled to a resilient element distinct from the upper sheet 102, or by any other resilient configuration.

In the illustrated embodiment, as best shown in FIG. 3C, the rim abutting segment 202 is sized such that when the front inner lip 66 is fully received in the lip receiving recess 210, the rim abutting segment 202 substantially entirely covers the top rim surface 76 of the front inner lip 66. In the illustrated embodiment, when the front inner lip 66 is fully received in the lip receiving recess 210, the front segment end 204 of the rim abutting segment 202 is in substantially vertical alignment with the front rim edge 72 of the front inner lip 66. Alternatively, the rim abutting segment 202 may be sized such that the front segment end 204 is located frontwardly from the front rim edge 72. In yet another embodiment, the rim abutting segment 202 may be sized such that the front segment end 204 is located rearwardly from the front rim edge 72 such that the rim abutting segment 202 does not fully cover the top rim surface 76.

Figure 2:
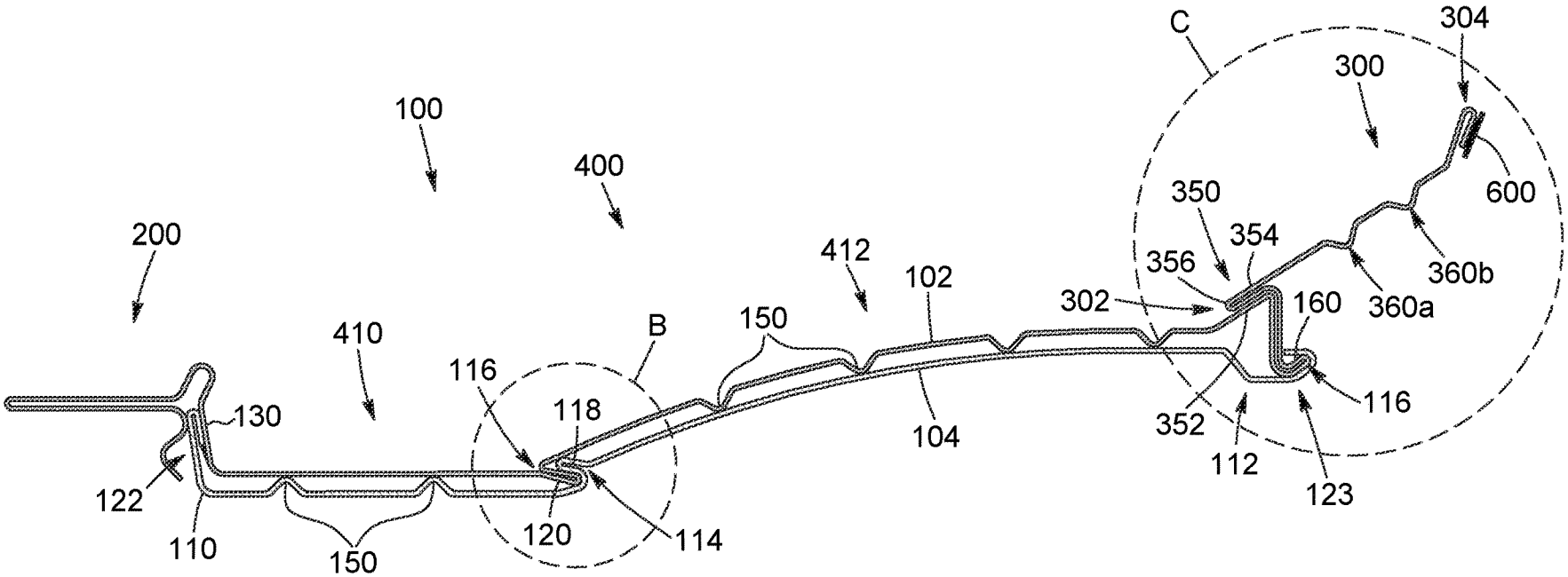
FIG. 2 is a cross-section view of the gutter cover illustrated in FIG. 1, shown in isolation.
Figure 5:
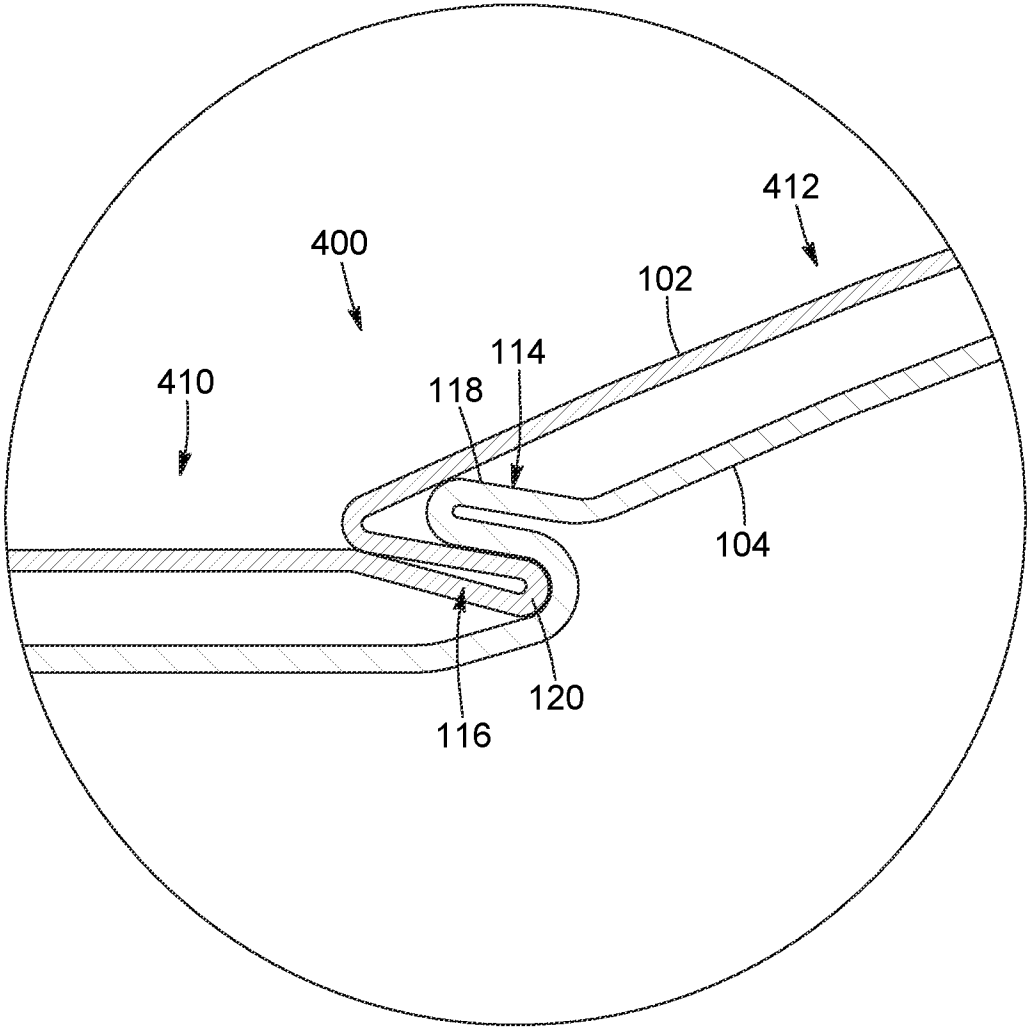
FIG. 5 is an enlarged portion of the cross-section view of the gutter cover illustrated in FIG. 2A, taken from area B.

Referring now to FIGS. 1, 2 and 5, the lower and upper segments 402, 404 of the central cover portion 400 extend substantially parallel to each other along their entire length and width.

In the illustrated embodiment, both the lower and upper segments 402, 404 include a front section 410, located adjacent the front cover mounting portion 200, and a rear section 412, extending between the front section 410 and the rear cover mounting portion 300. Still in the illustrated embodiment, the front section 410 is substantially planar and the rear section 412 is substantially curved, and more specifically convexly upwardly and away from the gutter channel 58 of the gutter 50.

The lower sheet 104 includes a front lower sheet end 110 and a rear lower sheet end 112 located opposite the front lower sheet end 110. In the illustrated embodiment, the upper and lower sheets 102, 104 further includes a plurality of protrusions 150 extending towards and abutting the opposite sheet 104, 102 to maintain the upper and lower sheets 102, 104 spaced apart from each other by a predetermined distance. To further contribute to maintaining the upper and lower sheets 102, 104 at a predetermined distance from each other, the lower sheet 104 includes an intermediate lower sheet connector 114 located between the front and rear lower sheet ends 110, 112 and the upper sheet 102 includes an intermediate upper sheet connector 116 configured to be engaged with the intermediate lower sheet connector 114 to prevent the upper and lower sheets 102, 104 from moving away from each other. More specifically, the intermediate upper sheet connector 116 is positioned along the upper sheet 102 such that the intermediate lower sheet connector 114 and the intermediate upper sheet connector 116 are substantially aligned with each other when the lower sheet 104 is secured to the upper sheet 102.

In the illustrated embodiment, the intermediate lower sheet connector 114 includes a lower sheet hook member 118 located between the front and rear sections 410, 412 of the lower sheet 104 and the intermediate upper sheet connector 116 includes an upper sheet hook member 120 located between the front and rear sections 410, 412 of the upper sheet 102. Specifically, the intermediate lower sheet connector 114 extends frontwardly and the intermediate upper sheet connector 116 extends rearwardly. Alternatively, the intermediate lower sheet connector 114 could extends rearwardly and the intermediate upper sheet connector 116 could extend frontwardly.

In the illustrated embodiment, the upper and lower sheet hook members 118, 120 are formed by 180-degree folds in the upper and lower sheets 102, 104, respectively. Alternatively, the upper and lower sheet hook members 118, 120 could instead be formed by bending or folding the upper and lower sheets 102, 104 in another suitable configuration. In another embodiment, the upper and lower sheet hook members 118, 120 could be provided as separate components secured to the upper and lower sheets 102, 104.

When the upper and lower sheets 102, 104 are assembled together to form the gutter cover 100, the upper and lower sheet hook members 118, 120 abut each other. More particularly, in the embodiment shown, the upper sheet hook member 118 is sandwiched between the rear section 412 of the upper sheet and the lower sheet hook member 120 while the lower sheet hook member 120 is sandwiched between the front section 410 of the lower sheet 104 and the upper sheet hook member 118.

Referring to FIGS. 1, 2 and 3C, the lower sheet 104 further includes a front connector 122 located at the front lower sheet end 110 for engaging the upper sheet 102 proximal the front cover mounting portion 200, and a rear connector 123 located at the rear lower sheet end 112 for engaging the upper sheet 102 proximal the rear cover mounting portion 200.

Specifically, with reference to FIG. 3C, the front connector 122 includes a front hook member 124 comprising an upright portion 126 extending at an angle relative to the front section 410 of the lower sheet 104 and an abutment portion 128 facing substantially downwardly towards the front section 410 of the lower sheet 104.

The upper sheet 102 includes an upright portion 130 extending at an angle relative to the front section 410 of the upper sheet 102 and located between the front cover mounting portion 200 and the central cover portion 400. The upright portion 130 is spaced away rearwardly from the lip retaining segment 212 to define a connector receiving recess 132 sized and shaped to receive the front hook member 120. The upper sheet 102 further includes at least one retention protrusion 134 protruding in the connector receiving recess 132 and extending frontwardly from the upright portion 130. In the non-limitative embodiment shown, the retention protrusion 134 comprises a plurality of spaced-apart wedge-shaped crimps 136. Each wedge-shaped crimp 136 includes a tapered portion 138 positioned such that when the gutter cover 100 is installed on the cover 50, the tapered portion 138 points substantially downwardly, and an abutment 140 which faces substantially upwardly to abut the abutment portion 128.

In one embodiment, the retention protrusions 134 are formed prior to the lower sheet 104 being engaged with the upper sheet 102. In this embodiment, to connect the front connector 114 to the upper sheet 102, the second sheet 104 is positioned below the first sheet 102 and the front hook member 120 is placed in substantially vertical alignment with the connector receiving recess 132. As the front hook member 120 enters the connector receiving recess 132, it slides against the retention protrusions 134 until the abutment portion 124 of the front hook member 120 is past the retention protrusion 134. The front hook member 120 is then prevented from being moved downwardly and out of the connector receiving recess 132 by the abutment portion 124 abutting against the retention protrusions 134, and more specifically against the abutment 140 of the retention protrusions 134. Alternatively, instead of being formed prior to insertion of the front hook member 120 into the connector receiving recess 132, the retention protrusion(s) 134 could be formed in the upright portion 130 below the abutment portion 124 after the front hook member 120 has been inserted into the connector receiving recess 132 using a suitable tool.

Figure 6:
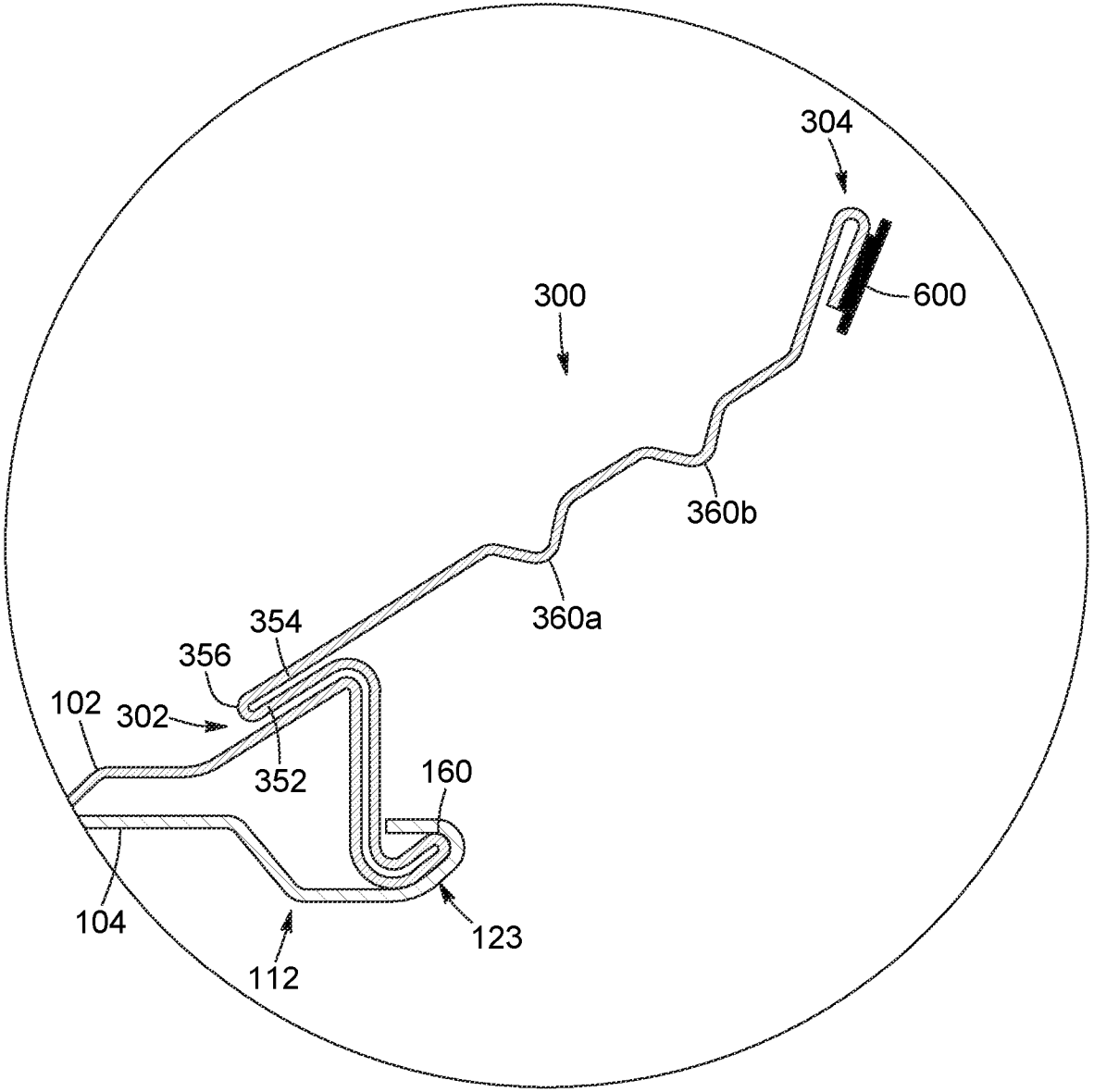
FIG. 6 is an enlarged portion of the cross-section view of the gutter cover illustrated in FIG. 2A, taken from area C.

Referring now to FIGS. 1, 2 and 6, in the illustrated embodiment, the upper sheet 102 further includes a rear hook member 160 located between the central cover portion 400 and the rear cover mounting portion 300 and extending downwardly to engage the rear connector 123 of the lower sheet 104. Specifically, the rear hook member 160 is formed by bending and folding the upper sheet 102 in the appropriate configuration. Alternatively, the rear hook member 160 could include a separate member secured to the upper sheet 102.

In the illustrated embodiment, the rear mounting cover portion 300 further includes a plurality of folds 350, 360*a*, 360*b* which allow the rear mounting portion 300 to be deformed when abutting the rear gutter wall 56. The folds 350, 360*a*, 360*b* are further resilient such that when deformed and abutting the rear gutter wall 56, the rear mounting portion 300 applies a pressure on the rear gutter wall 56. This may allow the rear mounting portion 300 to form a tighter fit with the rear gutter wall 56 to seal the rear mounting portion 300 against the rear gutter wall 56. This may further allow the gutter 100 to be installed over the gutter 50 even if the gutter cover 100 is slightly wider than the gutter 50. This would allow the gutter cover 100 to account for possible variations in width of gutters.

The rear cover mounting portion 300 includes a front end 302 adjacent the central cover portion 400 and a rear end 304 located opposite the front end portion 302. In the illustrated embodiment, the plurality of folds 350, 360*a*, 360*b* includes a front fold 350 located adjacent to the front end 302 and a plurality of rear portion folds 360*a*, 360*b* defined in the rear cover mounting portion 400. Specifically, the rear portion folds 360*a*, 360*b* extends along the rear cover mounting portion 300 in a longitudinal direction relative to the gutter 50 and are spaced from each other in a widthwise direction relative to the gutter 50. As shown in FIG. 1, when the rear end 304 of the rear cover mounting portion 300 abuts the rear gutter wall 56, the rear portion folds 360*a*, 360*b* allow the rear cover mounting portion 300 to be deformed such that the rear cover mounting portion 300 becomes curved, and more specifically curved convexly towards the gutter 50 below (or concavely when viewed from above). Therefore, the width and the orientation of the rear cover mounting portion 300 is slightly adjustable by the deformation of the rear portion folds 360*a*, 360*b* and the front fold 350. This means that the gutter cover 100 need not be exactly as wide as the gutter 50 and could be wider than the gutter 50. The gutter cover 100 could therefore be adapted to fit gutters having different widths instead of being designed to only be installed in a gutter having a specific width.

In the illustrated embodiment, the rear cover mounting portion 300 includes two rear portion folds 360*a*, 360*b* and both rear portion folds 360*a*, 360*b* extend substantially downwardly. Alternatively, the rear portion folds 360*a*, 360*b* could include only one rear portion fold, or more than two rear portion folds. In one embodiment, the rear portion folds 360*a*, 360*b* could instead extend upwardly from the rear cover mounting portion 300 or a first plurality of the rear portion folds could extend upwardly and a second plurality of the rear portion folds could extend downwardly.

In the illustrated embodiment, the front fold 350 is a 180-degree fold which extends towards the front cover mounting portion 200 and which is positioned above the central cover portion 400. Specifically, the front fold 350 includes a lower segment portion 352 which is superimposed over the central cover portion 400 and an upper segment portion 354 which is superimposed over the lower segment portion 352. The front fold 350 further includes a bend portion 356 resiliently connecting the lower and upper segment portions 352, 354 and located towards the front cover mounting portion 200.

When the gutter cover 100 is not installed on a gutter, as shown in FIG. 2, the lower and upper segment portions 352, 354 of the front fold 350 are substantially parallel to each other. When the gutter cover 100 is installed on the gutter 50 such that the rear mounting portion 300 abuts the rear gutter wall 56, as shown in FIG. 1, the upper segment portion 352 may pivot slightly upwardly about the bend portion 356 such that the lower and upper segment portions 352, 354 of the front fold 350 may be slightly angled relative to each other. The bend portion 356, forming a resilient connection between the upper and lower segment portions 352, 354, urges the upper segment portion 352 back towards the lower segment portion 354, which pushes the rear cover mounting portion 300 against the rear gutter wall 56 to further increase the sealing between the rear cover mounting portion 300 and the rear gutter wall 56. The rear cover mounting portion 300 could then be secured to the rear gutter wall 56 using one or more mechanical fasteners, not shown.

In the illustrated embodiment, to further increase the sealing between the rear cover mounting portion 100 and the rear gutter wall 56, the gutter cover 100 can further include a sealing member 600 secured to an underside of the rear cover mounting portion 300. The sealing member 600 could include a compressible and/or adhesive pad or layer which could be made of a resilient material such as foam, an elastomeric material or any other suitable material. The sealing member 600 is configured to abut the rear gutter wall 56 to form a seal between the rear cover mounting portion 300 and the rear gutter wall 56. It will be appreciated that in the illustrated embodiment, since the folds defined in the rear cover mounting portion 300 cause the rear cover mounting portion 300 to push against the rear gutter wall 56, the sealing member 600 is substantially compressed between the rear cover mounting portion 300 and the rear gutter wall 56 which may increase the efficiency of the sealing member 600.

In one embodiment, the rear cover mounting portion 300 could be made of a different material than the rest of the gutter cover 100. In other words, the rear cover mounting portion 300 could be made of a first material and the front cover mounting portion 200 and the central cover portion 400 could be made of a second material different from the first material. In this embodiment, the first material could be substantially more flexible than the second material to facilitate the curving of the rear cover mounting portion 300 against the rear gutter wall 56, as explained above. For example, the second material could include a metal such as aluminium, an aluminium alloy or the like, while the first material could include a polymer or a similar relatively flexible material.

Figure 7:
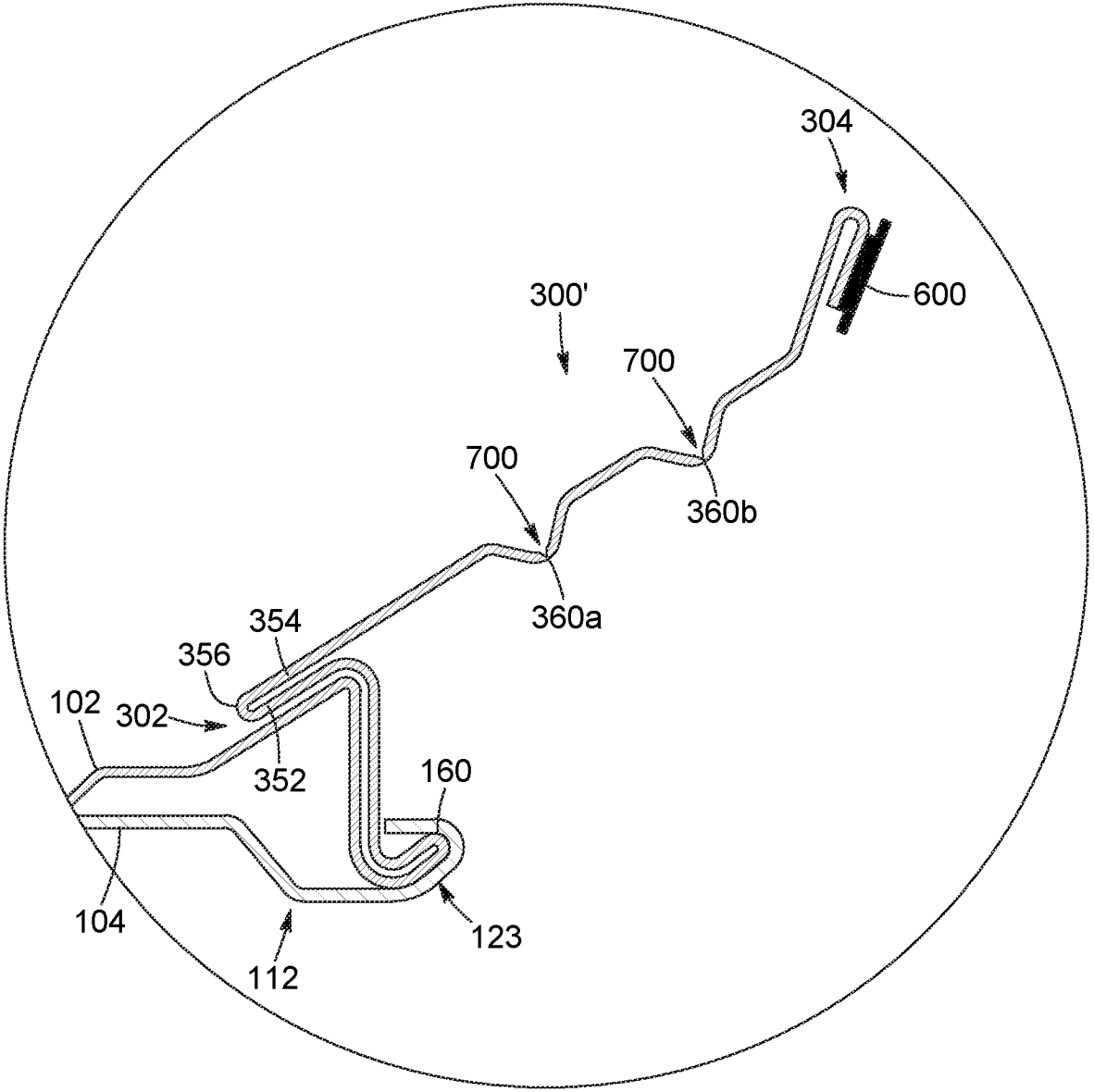
FIG. 7 is an enlarged portion of the cross-section view of a rear cover mounting portion of a gutter cover, in accordance with another embodiment.

The rear cover mounting portion 300 could further be configured such that its width is adjustable. Specifically, FIG. 7 shows a rear cover mounting portion 300' in accordance with one embodiment, which includes one or more scoring lines 700 extending along the rear cover mounting portion 300' in a longitudinal direction relative to the gutter 50 and, in addition to being relatively flexible, the first material could further be relatively easily separable along the scoring lines 700. The rear cover mounting portion 300' could be configured to be relatively easily separable such that a user may simply tear the rear cover mounting portion 300' along one of the scoring lines 700 by hand, or could be configured to be cut using a cutting tool.

In one embodiment, the scoring lines 700 could extend in the rear portion folds 360*a*, 360*b*. Alternatively, in an embodiment in which the rear cover mounting portion 300' does not include rear portion folds 360*a*, 360*b*, the scoring lines 700 could simply be spaced evenly or unevenly from each other widthwise along the rear cover mounting portion 300'.

The rear cover mounting portion 300' could also have a thickness which is substantially adapted to allow the rear cover mounting portion 300 to be torn by hand along the scoring lines 700. Specifically, the rear cover mounting portion 300' could have a thickness between about ⅛ inch and 1/16 inch. Alternatively, the rear cover mounting portion 300' could have any other suitable thickness.

In another embodiment, instead of being made of first and second materials which are different from each other, the entire gutter cover 100 could be made of the first material. For example, the entire gutter cover 100 could be made of a polymer. In yet another embodiment, instead of being made of a second material, the front cover mounting portion 200 and the central gutter portion 400 could be made of two or more different materials.

It will be appreciated that the gutter cover 100 is therefore particularly well-adapted to be used on existing gutters, in which the rear gutter wall 56 and/or the supporting surface of the building may include imperfections and/or features such as bumps, a drip edge or the like. In this case, it may be desirable to adjust the width of the rear cover mounting portion 300' to better follow the contour of the rear gutter wall 56 and/or the supporting surface of the building. The user can simply use the present gutter cover 100 and either use the entire gutter cover 50 with its full width or adjust its width by tearing the rear cover mounting portion 300' at an appropriate scoring line 700 to reduce the gutter cover's width as desired.

It will be understood that the embodiments described above are merely provided as examples and that other configurations may be considered. For example, instead of being double-layered and comprising upper and lower sheets, the gutter cover 100 could instead be single-layered and be entirely formed from one sheet of material. In another embodiment, the gutter cover could include the front cover mounting portion 200 configured for snap-fit engagement with a front inner lip of a gutter, as described above, but the rear cover mounting portion 300 may not include any folds and/or may not be deformable. In another embodiment, the rear cover mounting portion could include one or more folds as described above, but the front cover mounting portion may not be configured to engage the gutter in a snap-fit engagement as described above.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A gutter cover for covering an opening of a gutter having a front gutter wall, a rear gutter wall and a bottom gutter wall defining a gutter channel, the gutter cover comprising:

a front cover mounting portion operatively engageable with the front wall of the gutter, a rear cover mounting portion operatively engageable with the rear wall of the gutter and a central cover portion extending between the front cover mounting portion and the rear cover mounting portion, the rear cover mounting portion having a section extending upwardly and rearwardly from the central cover portion including at least one resilient fold extending longitudinally along the gutter cover to allow the rear cover mounting portion to be resiliently deformed when abutting against an inner surface of the rear gutter wall.

2. The gutter cover as claimed in claim 1, wherein the at least one resilient fold further includes a 180-degree fold located adjacent the central cover portion.

3. The gutter cover as claimed in claim 2, wherein the 180-degree fold extends towards the front cover mounting portion and is positioned above the central cover portion.

4. The gutter cover as claimed in claim 3, wherein the 180-degree fold includes a lower segment portion superimposed over the central cover portion, an upper segment portion superimposed over the lower segment portion and a bend portion resiliently connecting the lower and upper segment portions and located towards the front cover mounting portion.

5. The gutter cover as claimed in claim 1, wherein the at least one resilient fold includes a plurality of rear portion folds spaced from each other in a widthwise direction relative to the gutter.

6. The gutter cover as claimed in claim 5, wherein at least one of the rear portion folds extends downwardly from the rear cover mounting portion.

7. The gutter cover as claimed in claim 1, further comprising a sealing member secured to an underside of the rear cover mounting portion, the sealing member being configured to abut the rear gutter wall to form a seal between the rear cover mounting portion and the rear gutter wall.

8. A gutter assembly comprising:

a gutter having a front gutter wall, a rear gutter wall and a bottom gutter wall defining a gutter channel having an open top, the front gutter wall including an upright segment and a front inner lip extending rearwardly from the upright segment, the front inner lip including a rim segment having a front rim edge, a rear rim edge and a top rim surface extending between the front and rear rim edges;

a gutter cover for covering the open top of the gutter, the gutter cover comprising:

a front cover mounting portion operatively engageable with the front wall of the gutter, a rear cover mounting portion operatively engageable with the rear wall of the gutter and a central cover portion extending between the front cover mounting portion and the rear cover mounting portion, the rear cover mounting portion having a section extending upwardly and rearwardly from the central cover portion including at least one resilient fold extending longitudinally along the gutter cover to allow the rear cover mounting portion to be resiliently deformed when abutting against an inner surface of the rear gutter wall.

9. The gutter assembly as claimed in claim 8, wherein the at least one resilient fold further includes a 180-degree fold located adjacent the central cover portion.

10. The gutter assembly as claimed in claim 9, wherein the 180-degree fold extends towards the front cover mounting portion and is positioned above the central cover portion.

11. The gutter assembly as claimed in claim 10, wherein the 180-degree fold includes a lower segment portion superimposed over the central cover portion, an upper segment portion superimposed over the lower segment portion and a bend portion resiliently connecting the lower and upper segment portions and located towards the front cover mounting portion.

12. The gutter assembly as claimed in claim 8, wherein the at least one resilient fold includes a plurality of rear portion folds spaced from each other in a widthwise direction relative to the gutter.

13. The gutter assembly as claimed in claim 12, wherein at least one of the rear portion folds extends downwardly from the rear cover mounting portion.

14. The gutter assembly as claimed in claim 8, further comprising a sealing member secured to an underside of the rear cover mounting portion, the sealing member being configured to abut the rear gutter wall to form a seal between the rear cover mounting portion and the rear gutter wall.

15. A gutter cover for covering an opening of a gutter having a front gutter wall, a rear gutter wall and a bottom gutter wall defining a gutter channel, the gutter cover comprising:

a front cover mounting portion operatively engageable with the front wall of the gutter, a rear cover mounting portion operatively engageable with the rear wall of the gutter and a central cover portion extending between the front cover mounting portion and the rear cover mounting portion, the rear cover mounting portion including at least one scoring groove extending in a longitudinal direction relative to the gutter, the rear cover mounting portion being made of a first material which is substantially flexible and which is separable along the at least one scoring groove to thereby reduce a width of the rear cover mounting portion.

16. The gutter cover as claimed in claim 15, wherein the first material includes a polymer.

17. The gutter cover as claimed in claim 15, wherein the rear cover mounting portion has a thickness between about ⅛ inch and 1/16 inch.

18. The gutter cover as claimed in claim 15, wherein the front cover mounting portion and the central cover portion are made from a second material different from the first material.

19. The gutter cover as claimed in claim 15, the rear cover mounting portion comprises a section extending upwardly and rearwardly from the central cover portion and including at least one resilient fold extending longitudinally along the gutter cover to allow the rear cover mounting portion to be resiliently deformed when abutting against the rear gutter wall.

* * * * *